US005285212A

United States Patent [19]

McNiece

[11] Patent Number: 5,285,212

[45] Date of Patent: Feb. 8, 1994

[54] SELF-SUPPORTING COLUMNAR ANTENNA ARRAY

[75] Inventor: Robert K. McNiece, Centreville, Va.

[73] Assignee: Radiation Systems, Inc., Sterling, Va.

[21] Appl. No.: 946,071

[22] Filed: Sep. 18, 1992

[51] Int. Cl.[5] ..... H01Q 9/28

[52] U.S. Cl. ..... 343/795; 343/873; 343/893

[58] Field of Search ..... 343/795, 797, 700 MS, 343/872, 878, 879, 826, 893; H01Q 1/42, 9/28, 1/38, 1/40, 21/12, 21/61, 21/8, 21/10

[56] References Cited

U.S. PATENT DOCUMENTS

| | | | |
|---|---|---|---|
| 3,747,114 | 7/1973 | Shyhalla | 343/795 |
| 3,836,977 | 9/1974 | Wheeler | 343/815 |
| 4,083,050 | 4/1978 | Hall | 343/729 |
| 4,436,569 | 3/1984 | Somerfleck | 152/217 |
| 4,633,262 | 12/1986 | Traut | 343/700 MS |
| 4,758,843 | 7/1988 | Agrawal et al. | 343/814 |
| 4,851,855 | 7/1989 | Tsukamoto et al. | 343/873 |
| 4,914,449 | 4/1990 | Fukuzawa et al. | 343/872 |
| 4,980,696 | 12/1990 | Stone et al. | 343/872 |

*Primary Examiner*—Michael C. Wimer
*Assistant Examiner*—Tan Ho
*Attorney, Agent, or Firm*—Pollock, Vande Sande & Priddy

[57] ABSTRACT

A columnar antenna array. A printed circuit board has on one side thereof a plurality of etched dipoles arranged in a linear array. On an opposite side of the circuit board is an excitation network for exciting each of the dipoles. The excitation network terminates in a connector to receive a radio frequency signal. The circuit board includes a plurality of openings in the spaces between the dipoles. An injection molding process encapsulates the circuit board in an encapsulation compound. A supporting surface perpendicular to the printed circuit board extending through the openings is formed during the injection molding process. Integral mounting supports are formed in the encapsulation material at each end of the circuit board for facilitating mounting of the columnar array to a frame.

9 Claims, 2 Drawing Sheets

SELF-SUPPORTING COLUMNAR ANTENNA ARRAY

The present invention relates to microwave antenna arrays. Specifically, a colinear antenna array is described in the form of a printed circuit array which is encapsulated to form a weather-proof structure, as well as to form mounting supports for the colinear array.

Microwave antenna systems which are used in navigation facilities, such as IFF transponder interrogation and reception equipment, employ a plurality of colinear antenna arrays supported in front of a reflector surface. As described in U.S. Pat. No. 3,836,977 the colinear arrays are held in position by a supporting structure in a fixed relationship with a plurality of conductive columns. Typically, the colinear antenna array comprises a group of dipole elements, all supported by a conductive column. The conductive column is hollow so that transmission lines can be connected to each of the dipoles without interfering with the radiation pattern of the array.

The construction of the dipole array which exposes the dipoles to a reflector without also exposing the feed line structure for each dipole, requires numerous assembly steps which are tedious and subject to defects in workmanship during assembly of the dipoles to the conductive column. Once assembled, the structure must be weatherized so that moisture does not enter the assembly and adversely affect the operation of the antenna.

Once assembled, the columns must be connected to a support frame along with other columns and with conductive elements such as is shown in the aforesaid prior art patent. These additional steps require that there be some mounting structure formed on the columnar array so that it can be securely mounted to the support frame.

The present invention provides for a columnar array which provides an encapsulation surface which both weatherproofs the antenna array as well as provides f or mounting surfaces suitable for connecting to the frame structure. The mounting areas are made of the same encapsulation material. The assembly steps necessary to construct the array, the weatherproofing, and the necessary mounting structures for supporting the array are accomplished in a simple and economical way.

SUMMARY OF THE INVENTION

It is an object of this invention to provide for a weatherproof colinear array having integral mounting supports.

It is a more specific object of this invention to provide a colinear array of dipole elements made in a stripline structure which is subject to injection molding to form a weatherproof surface having integral mounting supports.

These and other objects of the invention are provided from a printed circuit array of antenna elements which are colinearly arranged into a columnar array. The printed circuit antenna elements are excited from a feed network such that each element receives the correct amplitude and phase of radio frequency energy to derive the radiation pattern of interest.

Each of the elements of the array are spaced apart around symmetrical openings in the printed circuit surface. The entire printed circuit array is encapsulated in an encapsulation compound. The encapsulation is applied through an injection molding process which provides molded supports from the encapsulation compound at each end of the array as well in the middle of the array. The encapsulation provides a weather-tight covering for the printed circuit array, as well as integral support structures for mounting the array into a frame with other colinear arrays.

In accordance with a preferred embodiment of the invention, a series of dipoles are etched on one side of the printed circuit board, separated by the openings in the circuit board. On the opposite side of the circuit board, a feed network is etched. The feed network forms a stripline network with a ground plane which is attached to the opposite surface of a dielectric material abutting the feed network.

A connector is connected to the circuit board having a common connection touching the ground plane and a center connection connected to one end of the printed circuit board feed network. A radio frequency excitation signal applied to the connector is distributed by the stripline network to each of the dipoles.

The entire dipole/feed network structure is subject to an injection molding of encapsulation material. A planar surface of encapsulation material perpendicular to the circuit board surface is formed in the injection molding process which extends through the openings along the entire length of the circuit board. The injection molding process provides mounting supports of encapsulation material at each end of the printed circuit board which is integral with the planar surface formed of injection material. A similar mounting structure is provided towards the center of the printed circuit board formed from a second surface parallel to the first surface of encapsulation material. The entire preferred embodiment therefore consists of a totally encapsulated colinear array, having integral mounting structures for connection to a frame supporting additional colinear arrays.

DESCRIPTION OF THE PREFERRED EMBODIMENT

Figures 1, 2, 3:
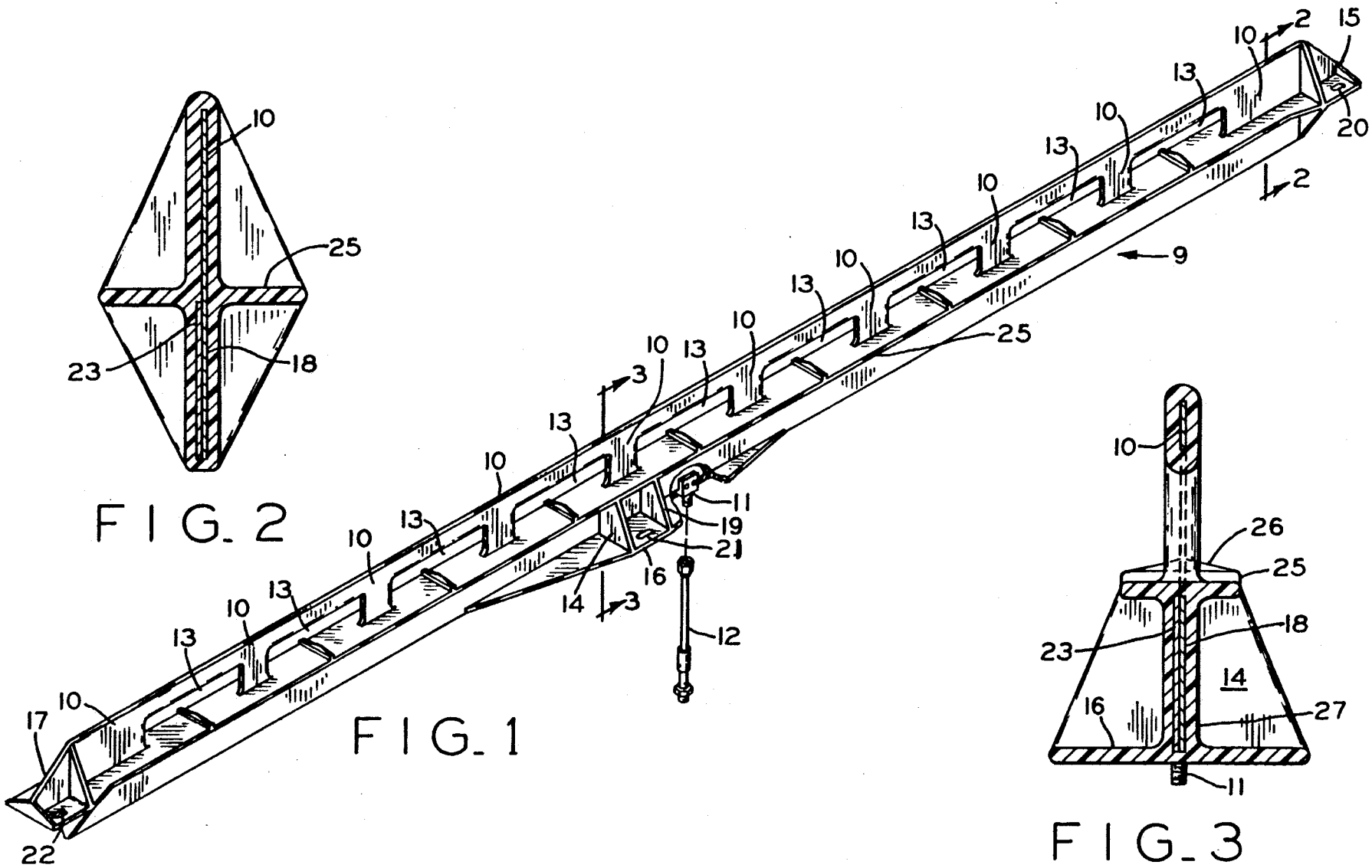
FIG. 1 is a perspective view of a colinear array made in accordance with a preferred embodiment of the invention.
FIG. 2 is a first section view of the antenna structure of FIG. 1.
FIG. 3 is a second section of the preferred embodiment of FIG. 1, illustrating the center mount for the colinear array of FIG. 1.

Referring now to FIGS. 1, 2 and 3, there is shown a preferred embodiment of the present invention. The preferred embodiment includes an array of antenna elements 10 which have been encapsulated in an encapsulating compound to weatherproof the antenna structure, as well as creates three supports 15, 16 and 17, for supporting the array in a frame. The ten dipole elements 10 are separated by openings 13. The encapsulation compound 9 forms a surface 25 perpendicular to the antenna elements 10, which is extended to form each of the end mounting supports 15 and 17. Surface 25 is formed during an injection molding process which covers a planar array of antenna elements 10, as well as forms the mounting surfaces 15, 16 and 17. The injection molding process leaves a surface residue 26 which does not in any way interfere with the use and performance of the finished antenna array.

The antenna array includes a feed network for exciting each of the antenna elements 10 with a radio frequency signal having the required phase and amplitude, as well as forming a receive signal from each of the antenna elements 10. The feed network terminates in a connector 11. The cable 12 connects the antenna to a transmit/receive facility.

Figure 4:
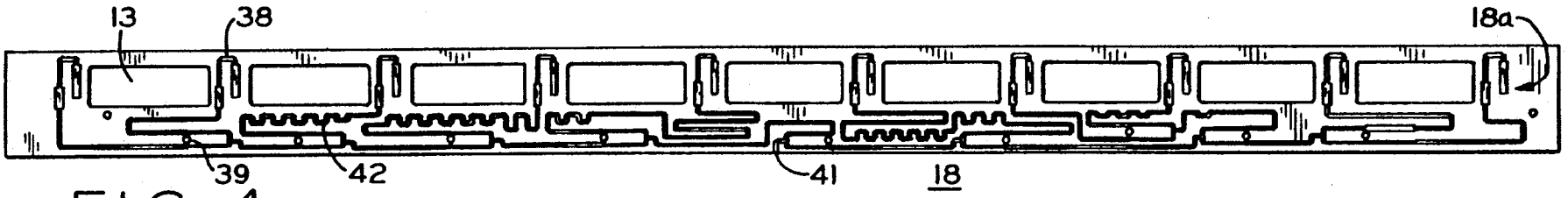
FIG. 4 illustrates the printed circuit feed network before encapsulation.
Figure 5:
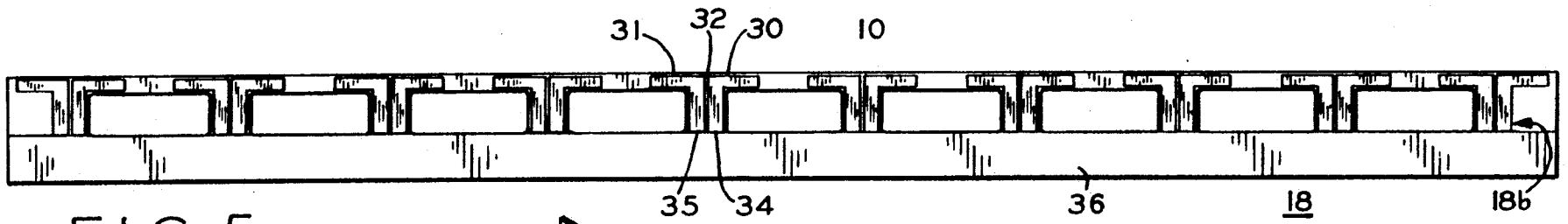
FIG. 5 is a view of the printed circuit board opposite the surface shown in FIG. 4 which supports the antenna elements 10.

The device of FIG. 1 begins as a printed circuit board 18 having two sides, 18*a* and 18*b*, as shown in FIGS. 4 and 5, respectively. FIG. 4 illustrates a feed network printed on side 18*a* for feeding ten dipole elements which are printed on the reverse side 18*b* shown in FIG. 5. Each of the dipole elements 10 is excited from the coupling members 38. Dipoles 10 include two radiating elements 30, 31, separated by a small non-conducting space 32. The radiating elements 30, 31 are connected to feedline sections which are themselves connected together at their distal ends 34, 35 by a single conductor 36. A section of dielectric material 3 supports each of the radiating elements 30 and 31. The rectangular openings 13 between antenna elements decrease the weight and wind loading of the colinear array once it is installed in its respective array frame.

The feed network of FIG. 4 is conventional stripline circuitry, terminating in a single conductive pad 41. A plurality of resistors 39 are shown, as well as transformer sections 42 and coupling members 38, which are in registry with the dipole elements 10. The resistors 39 are located within a cavity cut into the printed circuit board, the ends of which are soldered to the respective transmission line portions of the feed network.

Figure 6:
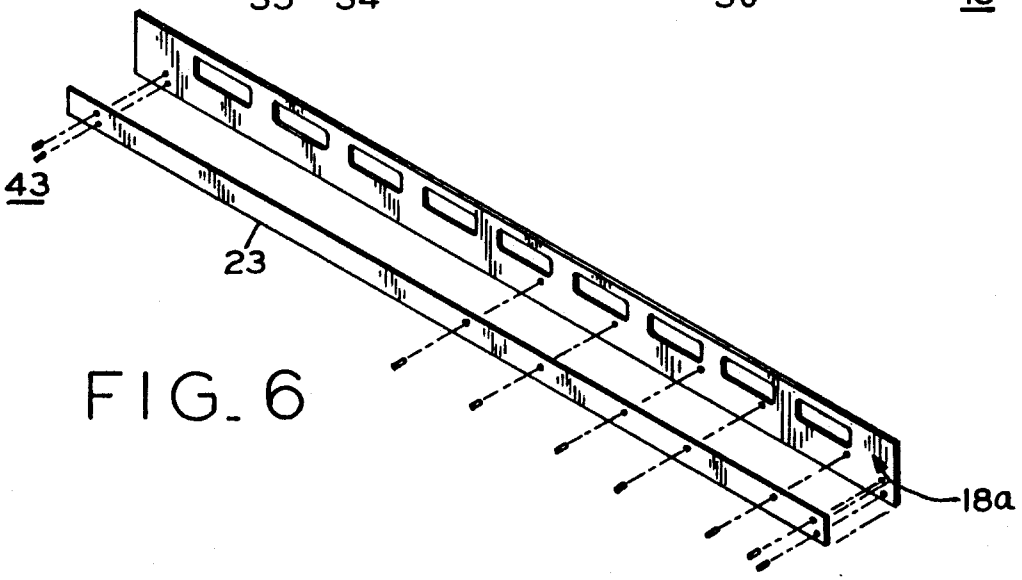
FIG. 6 shows the relationship of the ground plane 23 with respect to surface 18*a* of the printed circuit board.

During assembly, the ground plane 23 is connected to the side 18*a* of FIG. 5, as shown in FIG. 6. The ground plane 23 consists of a double-sided printed circuit board having the cladding of one side removed to expose the dielectric material while having the other side fully cladded. The exposed dielectric is fastened into abutting relationship with the feed network side 18*a* of the printed circuit board. Suitable fasteners 43 are shown, such as eyelets, holding the ground plane in place. The fully cladded opposite side serves as a ground plane. The ground plane occupies the space between the lower edge of the printed circuit board and the openings 13, and forms a second connection for a connector which is soldered to pad 41.

In operation, radio frequency energy applied via a cable 12 (see FIG. 1) to a connector 11 propagates through the stripline feed network comprising the network of surface 18*a* and ground plane 23 to excite each of the ten dipole elements on the reverse side of the printed circuit surface.

The assembly of the ground plane 23 and printed circuit board 18 is subjected to an injection molding process, such that the entire surface is covered with encapsulation material 9. The encapsulation material may be a Mobay 726 urethane. Rectangular openings 13 in the array permit the surface 25 to be formed which provides rigidity to the entire structure as well as a common surface for mounting supports 15 and 17. The injection molding process also forms perpendicular surface 16 parallel to surface 25, webbing structure 14 and 19, as well as the webbing elements of mounting supports 15 and 17 from the encapsulation material 9. A small space is left to expose the connector 11 so that a cable 12 may be connected thereto.

The encapsulation process performed through injection molding provides for a lightweight and totally weatherproof structure which is self-supporting. The tedious assembly processes of installing individual dipole elements in a columnar structure is avoided, as well as the necessity to attach any mounting structures to the column assembly through further assembly procedures.

Thus, the manufacture requires a relatively inexpensive printed circuit structure such as is shown in FIGS. 4 and 5, along with a ground plane 23 to form a stripline feed network. Once the ground plane 23 is fastened to the printed circuit structure 18, it is ready for the injection molding process. The injection mold includes all the cavities necessary to form surface 25 and the supports 15, 16 and 17. Each of the supports 15, 16 and 17 include mounting holes 20, 21, 22 to receive the mounting bolts of the array frame which supports a plurality of such colinear arrays.

Thus, there has been described with respect to one embodiment a new columnar array of colinear elements which can be manufactured and produced with a simplified assembly structure. Those skilled in the art will recognize yet other embodiments of the invention defined more particularly by the claims which follow.

What is claimed is:

1. A columnar antenna array comprising;

a printed circuit board having on one side thereof a plurality of dipoles formed in a linear array, each dipole including first and second in line dipole elements connected to first and second conductors of a feedline, and wherein said circuit board includes a plurality of open portions between each dipole feedline, and having a feed network for supplying a radio frequently signal to each dipole feedline;

a connector connected to an edge of said printed circuit board in contact with said feed network; and, an encapsulating compound surrounding said printed circuit board exposing said connector, and forming at first and second ends of said printed circuit board first and second mounting supports for said antenna array.

2. The columnar antenna array of claim 1 wherein said feed network comprises a stripline network disposed on a side of said circuit board opposite said one side having said plurality of dipoles.

3. The columnar antenna array of claim 1 further comprising a mounting support formed on encapsulating compound substantially midway between said first and second ends of said printed circuit board.

4. The columnar antenna array of claim 1 wherein said encapsulating compound forms a flat surface over the length of said printed circuit board and perpendicular thereto, expanding through said open portions.

5. A columnar antenna array comprising:

a printed circuit board having on one side thereof a plurality of dipoles arranged in a linear array, said circuit board including on an opposite side thereof an excitation network for exciting said dipoles, which terminates in a connector which receives a radio frequency signal, said circuit board including a plurality of openings in the space between said dipoles; and, an encapsulation compound covering said circuit board, extending through said openings forming a supporting surface perpendicular to the printed circuit board, said supporting surface including first and second integral mounting supports for fastening said columnar antenna to a frame which supports a plurality of columnar arrays.

6. The columnar antenna array of claim 5 further comprising a third mounting support located midway between said first and second mounting supports.

7. A columnar antenna array comprising:

a rectangular printed circuit board having on one side thereof an array of antenna elements, evenly spaced along the length of said printed circuit board, said antenna elements being coupled to a common feed network on said printed circuit board which is connected at one end to a connector which receives a radio frequency signal, said circuit board including a plurality of openings separating each of said antenna elements; and, an encapsulating compound injection molded about said printed circuit board forming a surface which is perpendicular to said circuit board, and forming mounting supports at each end of said printed circuit board for supporting the columnar antenna array on a frame.

8. The columnar antenna array of claim 7 wherein said feed network includes printed circuit elements located on an opposite side of said printed circuit board, and a ground plane is placed along the length of said opposite side partially covering the width of said printed circuit board without covering said openings, spaced from said circuit elements, forming a stripline network structure with said circuit elements.

9. The columnar antenna array of claim 7 wherein said antenna elements are dipoles arranged in a line along the length of said printed circuit board.

* * * * *